United States Patent [19]

Belles

Best Available Copy

[11] 4,296,957

[45] Oct. 27, 1981

[54] CHAIN-LOCK ACTUATED MAGNETIC SWITCH

[75] Inventor: David E. Belles, Pittsford, N.Y.

[73] Assignee: Lok-A-Wat, Inc., Adamsville, Tenn.

[21] Appl. No.: 78,132

[22] Filed: Sep. 24, 1979

[51] Int. Cl.[3] ..... E05C 17/36; E05C 13/10

[52] U.S. Cl. ..... 292/264

[58] Field of Search ..... 292/144, 201, 264, 251.5, 292/1

[56] References Cited

U.S. PATENT DOCUMENTS

| | | | |
|---|---|---|---|
| 1,987,913 | 1/1935 | Schulz | 292/264 |
| 3,087,751 | 4/1963 | Nisenbaum | 292/264 |
| 3,426,166 | 2/1969 | Canceill | 292/251.5 |

FOREIGN PATENT DOCUMENTS

| | | | |
|---|---|---|---|
| 7465 | 1/1894 | Fed. Rep. of Germany | 292/264 |

*Primary Examiner*—Richard E. Moore

*Attorney, Agent, or Firm*—Littlepage & Webner

[57] ABSTRACT

A normally open reed switch mounted on a door jamb is closed by a magnet in a chain-lock keeper when the door is closed. A pole piece, which functions as a bolt on the end of the chain, engages in the keeper and shunts the flux of the permanent magnet so that the reed switch is not effected by the flux, and assumes its normally open condition if the bolt is seated home in the keeper.

3 Claims, 2 Drawing Figures

CHAIN-LOCK ACTUATED MAGNETIC SWITCH

FIELD OF INVENTION

Communications, electrical, automatically responsive to condition, door, knob, lock or drawer.

Prior Art

Wertz U.S. Pat. No. 3,009,033; Hawkins U.S. Pat. No. 3,406,386; Heilstrom U.S. Pat. No. 3,714,644.

OBJECTS

This invention has particular utility as a control member for an energy saving system such as shown in the Dalton et al. U.S. Pat. No. 4,058,740, wherein a control circuit either stops or reduces electrical power consumption in a room such as a motel room, if a dead bolt or chain-lock is not closed after a predetermined interval following closure of the door. This protects the occupant when he enters the room by turning-off or turning-down the electrical power-consuming devices, such as the television, air conditioner, electric radiator and main room lights if he fails to close an extra-safe lock; and it shuts off the main power-consuming devices shortly after the occupant leaves the room.

Although magnetically actuated door switches for detecting door-open or door-closed conditions are well known, and while lock-actuated switches for detecting door-locked or door-unlocked conditions are known, the object now is to provide a single magnet-responsive switch for detecting (a) a door-open condition, (b) door-closed and unlocked condition; and (c) door-closed and locked condition.

To attain the foregoing broad objectives it is intended now to provide a keeper for a chain-lock for mounting on a door stile, a magnet-responsive switch for mounting on the door jamb directly opposite the keeper, which switch is normally in one condition (e.g., open) a magnet in the keeper whose flux normally actuates the switch to another condition (e.g., closed) when the door is closed and a plate-shaped bolt on the lock chain for engaging in the keeper wherein, the bolt, when seated home in the keeper, constitutes a pole piece for the magnet to shunt its flux so as to prevent it from actuating the switch to the other (closed) condition.

A further object of the invention is to provide a magnet-containing keeper for chain-lock which is readily adaptable to left or right-hand doors, and which accommodates a flux-shunting bolt on the right-hand side of the magnet (for use on right-hand doors), and which also accommodates the flux-shunting bolt on the left-hand side of the magnet (for when the keeper is used on a left-hand door).

Figure 1:
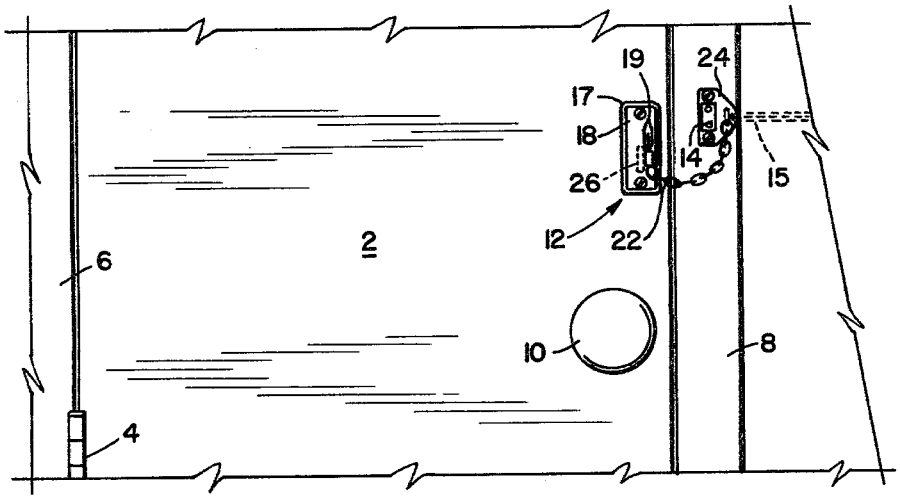
Figure 2:
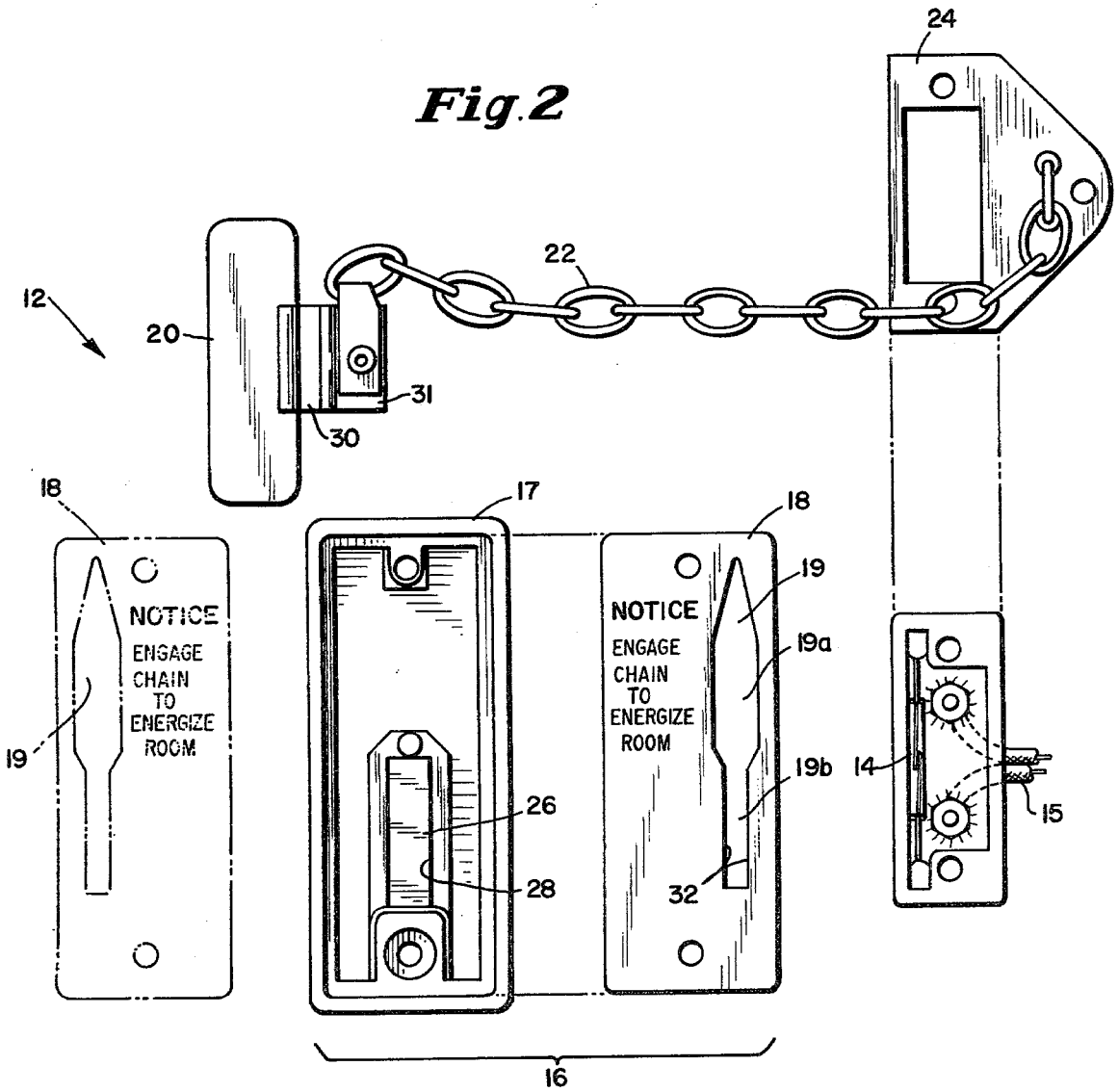

These and other objects will be apparent from the following specification and drawing in which FIG. 1 is an elevational view showing the device in typical use on a right-hand door; and, FIG. 2 is an exploded view of the chain-lock actuated magnetic switch assembly, showing the keeper plate in full lines for when the assembly is used on a right-hand door and showing the keeper plate in dash lines when the assembly is to be used on a left-hand door.

Referring now to the drawing, in which like reference numerals denote similar elements, the door 2 is conventional, arranged for right-hand opening, with typical hinges 4 which pivotally mount the door on the hinge jamb 6. The striker-jamb 8 is to the right of the door which, as usual, has a knob 10. The invention is concerned with the chain-lock and door-detecting switch assembly 12 which is comprised of a reed switch 14 mounted on the striker-jamb 8 adjacent its edge and provided with the usual leads 15 for connecting it to the circuit to be controlled. The leads would normally be concealed in the striker jamb 8.

The keeper 16 is comprised of a box 17 covered by a keeper plate 18 having a slot 19 for receiving a plate-shaped bolt 20 of magnet-responsive material, such as an iron alloy on the end of a chain 22 whose other end is attached to the striker-jamb 8 by an anchor 24. A permanent magnet 26 is disposed in a socket 28 in the center of the box 17. The bolt 20 is long enough to serve as a pole piece for the magnet.

In operation, the reed switch, which in this instance is normally open, is magnet-responsive, and is open when the door is open. When the door is closed, and until the bolt 20 is seated home in the slot in the keeper plate, the flux of permanent magnet 26 actuates the reed switch to close it. However, when the bolt 20 is seated home in the slot 19, the plate-shaped bolt 20 shunts the magnetic flux so that it cannot actuate the normally-open reed switch to its other or closed condition. If the device is to be used on a left-hand door, the keeper plate 18 is reversed so as to dispose the slot 19 on the left-hand side of the magnet 26.

The slot 19 has an enlarged upper port 19*a* and a relatively narrow portion 19*b*. The bolt 20 is inserted through the large upper portion 19*a* of the slot and then pulled downwardly to the narrow portion 19*b*. In this latter condition, the grooves 30 on opposite sides of the finger piece 31 by which the chain 20 is attached to the plate-shaped bolt 20 engage over the opposite edges 32 of the narrow portion 19*b* of slot 19 so that the bolt cannot be removed by pulling it outwardly.

While the switch 14 has been described as normally open, a normally closed switch may be used, with appropriate adaptations in the circuit which it controls.

I claim:

1. A chain-lock actuated magnetic switch for use with a door having a stile, and a frame for the door having a striker jamb comprising:

a magnet-responsive switch adapted to be mounted on a door striker jamb and having a normal circuit-controlling condition and being magnetically actuatable to an abnormal circuit-controlling condition, a chain-lock keeper adapted to be mounted on a door stile opposite the switch, said keeper having a permanent magnet whose flux is normally capable of actuating the switch to its abnormal condition when the door is closed, a chain having anchor means on one end thereof for anchoring the same to the striker jamb, and a bolt on the other end of the chain, said bolt constituting pole piece means for said magnet for shunting the flux thereof when said bolt is seated home in said keeper whereby to prevent the same from actuating said magnet-responsive switch to said abnormal condition.

2. The combination claimed in claim 1, said keeper comprising a box having means for mounting said permanent magnet therein and a cover having an elongate slot for receiving said bolt, said slot overlying a space between said magnet and one side of the box and said bolt being disposed in said space when the bolt is seated home in said slot.

3. The combination claimed in claim 2, there being another space in said box between the magnet and the other side of said box, and said cover being reversible so that said slot may be disposed over the other space also, whereby said switch may be used for either left- or right-handed doors.

* * * * *